United States Patent [19]

Flanagan

[11] Patent Number: 4,587,985

[45] Date of Patent: May 13, 1986

[54] CLEANING OF VESSELS FOR HOLDING MATERIALS

[75] Inventor: Raymond Flanagan, Coulsdon, England

[73] Assignee: Si-Jet Limited, Coulsdon, England

[21] Appl. No.: 629,357

[22] Filed: Jul. 10, 1984

[51] Int. Cl.[4] ..... B08B 3/02; B08B 9/08

[52] U.S. Cl. ..... 134/169 R; 406/137; 406/144

[58] Field of Search ..... 134/166 R, 167 R, 168 R, 134/169 R, 171, 96, 98, 99, 155, 186; 4/490; 406/137, 144

[56] References Cited

U.S. PATENT DOCUMENTS

| | | | |
|---|---|---|---|
| 1,908,220 | 5/1933 | Chapman | 406/144 X |
| 3,233,919 | 2/1966 | Ullman, Jr. et al. | 134/186 X |
| 3,288,537 | 11/1966 | Hitch | 406/144 X |
| 3,421,639 | 1/1969 | Oka et al. | 406/144 |
| 3,512,540 | 5/1970 | Hughes | 134/167 R |
| 4,109,861 | 8/1978 | McHugh | 406/144 X |

FOREIGN PATENT DOCUMENTS

| | | | |
|---|---|---|---|
| 2206763 | 8/1973 | Fed. Rep. of Germany | 406/144 |
| 72381 | 6/1978 | Japan | 134/167 R |
| 6612274 | 3/1967 | Netherlands | 134/186 |
| 53956 | 5/1934 | Norway | 134/169 R |
| 320391 | 10/1929 | United Kingdom . | |
| 398062 | 9/1933 | United Kingdom . | |
| 615642 | 1/1949 | United Kingdom . | |
| 771220 | 3/1957 | United Kingdom . | |
| 1032537 | 6/1966 | United Kingdom . | |
| 1160910 | 8/1969 | United Kingdom . | |
| 1382574 | 2/1975 | United Kingdom . | |
| 1409423 | 10/1975 | United Kingdom . | |

OTHER PUBLICATIONS

Si-Jet-Solids Handling Portable Jet Pumps & Vacuum Recovery Systems.

Cleaning of Bulkcarriers with Gunclean-10 pages.

Illustration of a Holding Cleaning System Utilizing an Eductor.

*Primary Examiner*—Philip R. Coe

*Attorney, Agent, or Firm*—Bell, Seltzer, Park & Gibson

[57] ABSTRACT

Solids material remaining on the bottom of a vessel after discharge of solids material therefrom is washed by a pressurized jet of washing fluid from a washing apparatus through an aperture in the vessel bottom and into entrainment with a pressurized jet of fluid located beneath said aperture, produced by a jet entrainment arrangement, with the entrainment jet being projected in a direction which is substantially parallel to the vessel bottom and being exposed to the interior of the vessel through the aperture.

21 Claims, 14 Drawing Figures

Figures 1, 2, 3:
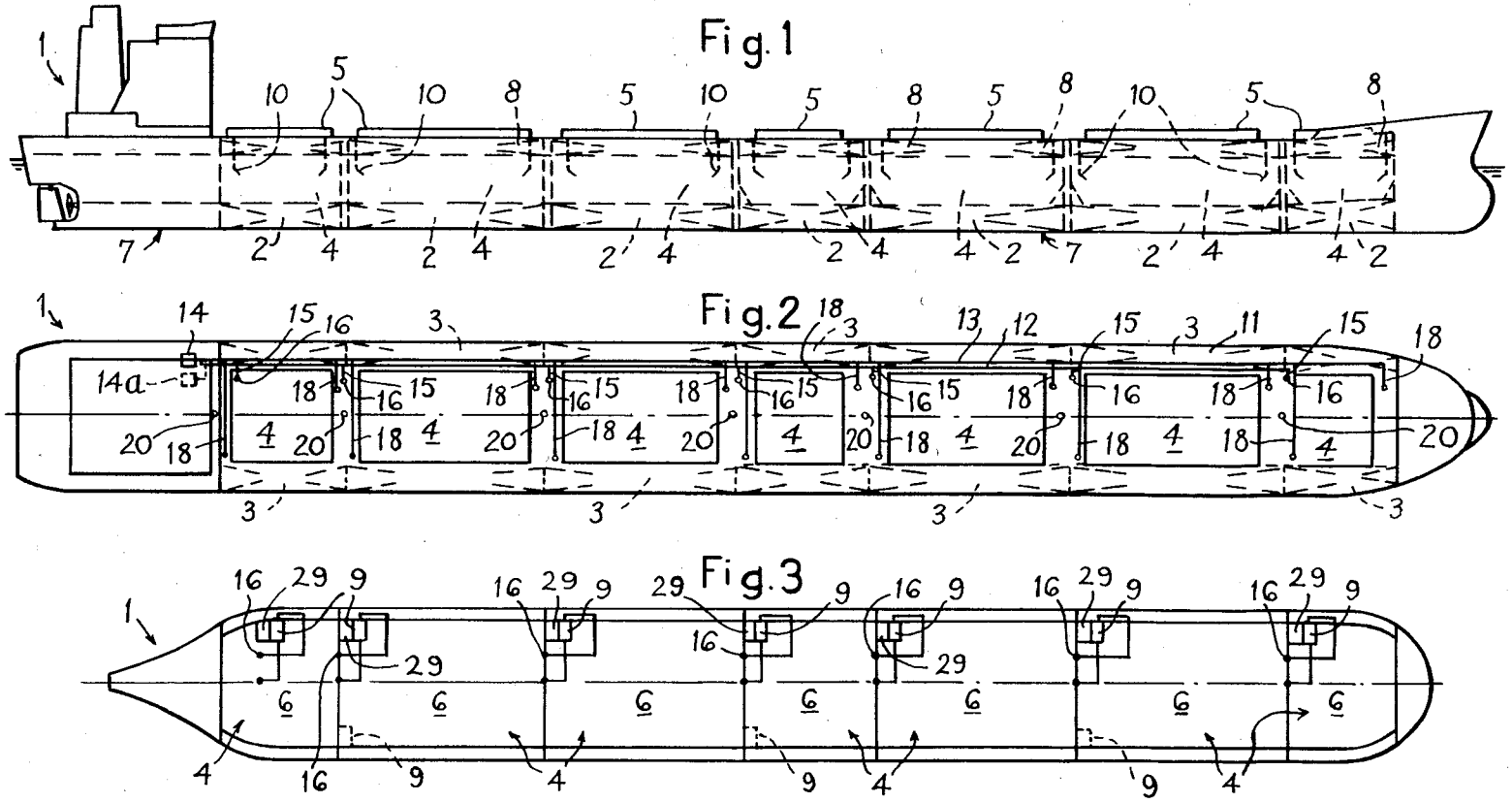

6
69
68
69
65
27
67
56
65
83
75
40
9

7
30
31a
30
26
16
35
34
32
37
9
34
66
65
69
56
46
43
38
43
39
68
64
61
58
40
59
51
49a
41
42
52
49
50
43
6
27
69
65
63
48
49
47
49a
60
61
62
57
55
67
X
X
33
36
34
34
20

CLEANING OF VESSELS FOR HOLDING MATERIALS

This invention relates to the cleaning of vessels from any solids element or residue remaining after the discharge of materials of liquid, gaseous or flowable solid form, or after maintenance operations involving derusting or descaling, which vessels can be land-based, or sea-based on rigs or platforms for material storage or be the cargo carrying holds or tanks of ships. The invention is more particularly concerned with the cleaning of the tanks or holds of ships.

Escalating manning costs in ships in recent years has, predictably, led to a concerted move on the part of owners to reduce their crews to the minimum compatable with statutory requirements and the efficient operation of their ships. This in turn has stimulated research into technical advances capable of eliminating or at least reducing labour intensive operations on board ships.

This is particularly true in the design and operation of bulk and combination carriers. However, in this field the task has been bedevilled by a swiftly changing pattern of world trade. The steady decline of the liner trade of such ships has given rise to a demand for highly flexible ships more suited to voyage and time chartering. In turn, this requirement has highlighted perhaps the most labour intensive operation of all in this class of ship—hold cleaning. The solids element remaining after the discharge of cargo which can be say grain at one time or say iron ore or coal the next time can be of the order of many tons. Not only can the solids element be left on the hold bottom but also residues can remain on the hold walls which have to be washed down to the hold bottom for removal. In derusting or descaling operations which usually involve the use of blasting grit, again many tons of solids have to be cleaned from the hold before anti-corrosion treatment can be carried out.

Various arguments have been advanced as to how often holds require cleaning, some operators maintaining it is only necessary when changing from one type of cargo to another while others clean their holds on a weekly basis. The truth is, there is no hard and fast rule on the subject. In some cases the nature of the cargo is such that if the holds are not washed immediately after discharge the residues can harden to a point where it is almost impossible to remove them. Again cargon residues harbour moisture which can aggravate corrosion problems. What is not in doubt, however, is the cleaning job whatever its nature is time consuming and labour intensive and therefore costly. The longer the cleaning job takes, the greater the down time, which in bulk and combination carriers reduces their flexibility and increases their operating costs.

Faced with the inevitable, the operator of bulk and combination carriers has two options open to him dependent on the previous cargo and the next one to be carried. These basically are, simple sweeping of the hold bottom or a combination of washing down and sweeping. Where washing down is involved there are again various options—the use of (a) ordinary wash hoses, (b) a high pressure wash unit inducing air into the water flow, (c) tank washing machines in either the fixed or portable mode but either way more usually associated with tank cleaning in oil tankers. The common factor in each case is that the solids element has to be removed from the hold bottom. Where washing down is involved this is even more essential if abrasive materials are not to find their way into the ballast lines and pumps causing potentially expensive damage.

Again, in the case of oil bulk ore or oil ore tankers, the residue left in the tanks after discharge of the oil may take the form of a thick sludge which has to be cleaned from the tank bottom before they are refilled which is time consuming, labour intensive and costly.

Similar problems exist with stationary land or sea-based material holding vessels such as containers, tanks or hoppers.

It should be appreciated that the term "bottom" is used herein in relation to "vessel" in a generic sense to embrace the tank top ceiling of a ship, the base area of a ship's hold on which cargo is supported and the floor of a storage container such as a hopper grain silo or tank, or bottom say of a sewage pond.

The length of time and number of personnel required to carry out the cleaning operation are directly related to the method which has hitherto been employed to remove the residue from the bottom of the vessel, and which is basically a "bucket and spade job". This can either involve the residue or other solids material, such as rust scale and grit blas abrasives, being spaded into bucket grabs or other suitable containers for transport out of the vessel for ultimate discharge, or alternatively, spaded into a portable jet pump which has been lowered into the vessel and is supported on the vessel bottom with its entrainment jet located above the vessel bottom. Even if the capacity of a portable jet pump could be increased whilst still keeping its portability, the cleaning time is still dictated by the ability and number of men to spade the solids material into the pump, the limit being typically, for a heavy material such as iron-ore, 2 to 2½ tons per man hour. Thus, the time consuming and labour intensive nature of this operation can be readily appreciated, particularly when one considers bulk carriers, which may have as many as eight holds, each 90 feet deep and having a bottom area of 700 square meters, for example.

In another hold cleaning system known to the applicants vertically arranged eductors are disposed behind the bulkheads, the eductors being enclosed within fluid lines which connect them to remotely disposed suction inlets in the hold bottom, and acting to suck the solids material from the holds. Such eductors are not very efficient, can block and in the event of wear from abrasive materials, the whole eductor has to be replaced, which is an expensive and time consuming operation, not the least because of the disposition of the eductors behind the bulkheads.

Recent reductions in manning level legislation have resulted in a more urgent need for a vessel cleaning system, in particular for the holds of ships, in which the aforesaid disadvantages are avoided or substantially reduced.

Accordingly, the main object of the present invention is to provide a method of and installation for cleaning vessels in which the cleaning time and number of personnel required are substantially reduced, which is much more efficient, in which any worn parts may be easily and quickly replaced, which can cope with the larger particle sizes of solids materials without sacrificing efficiency, which can both be installed in existing ships or into ships being built, and which in the case of bulk or combination carriers considerably increases their flexibility.

To this end and from one aspect, the present invention consists in a method of cleaning a vessel from solids material from the bottom of the vessel, in which the solids material is entrained in at least one pressurized jet of fluid, characterized by providing at least one aperture in the vessel bottom, generating said entrainment jet beneath said vessel bottom and said aperture, with said entrainment jet being projected in a direction which is substantially parallel with said vessel bottom and being exposed to the vessel interior through said aperture, providing at least one pressurized jet of washing fluid to wash the solids material from the vessel bottom, through said aperture and into entrainment with said entrainment jet, and leading the fluid entrained solids material out of the vessel.

From another aspect the present invention consists in an installation for use in cleaning solids material from the bottom of a vessel, in which the solids material is entrained in at least one pressurized jet of fluid, characterized by means defining at least one aperture in the vessel bottom, measns for producing a pressurized jet of fluid for entraining solids material therein, and disposed in at least one location beneath said vessel bottom and beneath said aperture, said means including nozzle means for projecting said entrainment jet in a direction which is transversely of said aperture and generally parallel with said vessel bottom, means for producing at least one pressurized jet of washing fluid for washing solids material from the vessel bottom, through said aperture and into said entrainment jet, and at least one discharge line for the passage of fluid entrained solids material out of the vessel, whereby in operation said entrainment jet is exposed to the vessel interior through said aperture, and solids material washed through the aperture by the pressurized washing fluid passes directly into said entrainment jet to be entrained therein and the fluid entrained solids material is discharged through said discharge line in the fluid flow engendered by the entrainment jet.

The invention also consists in a vessel, or a ship comprising at least one vessel such as a hold, provided with such an installation.

Because of the disposition and arrangement of the or each entrainment jet and the fact that the or each entrainment jet is exposed to the vessel interior through the aperture it is an extremely simple matter using pressurized jets of washing fluid to wash the solids material from the vessel bottom directly into the entrainment jet(s) which considerably reduces time and the number of operating personnel required. Since the entrainment jet is exposed to the vessel interior, i.e. is in direct communication therewith, without the solids material having to pass through a fluid line or through valves, speed and efficiency of cleaning is considerably increased as compared to all the systems known to the Applicant. Even if screens such as grilles, gratings of wire mesh or the like are placed over the aperture, which is preferred in order to prevent solids material having a particle size which is beyond the permissible maximum from entering the entrainment jet, this in no way interferes with the exposure of the entrainment jet to, or direct communication between the entrainment jet and, the vessel interior. When used on board ship the method and apparatus have considerable advantages over the known systems. Spading is eliminated. The number of ship personnel required to operate the method and installation can be reduced to as little as two. In the case of a bulk carrier changing over cargoes. the cleaning time can be reduced as little to 2–5 hours per hold depending on the materials involved. Thus, the requirement for flexibility with bulk and combination carriers is not only fully met but is to the applicant's knowledge met to a degree which is without parallel in any of the known hold cleaning systems. The method and installation can be operated under bad weather conditions at sea since the hatches can be left in position on the holds which eliminates the possibility of the loss of opened hatches overboard.

Furthermore, unlike cleaning systems utilizing partial suction with eductors, the method and installation according to the invention creates a positive head which allows vertical lifts well in excess of 30 meters to be achieved, which provides the further advantage that depths of tanks or holds for shipboard applications pose no problems. Morover, with installations constructed in accordance with the invention blocking is virtually eliminated and the throat size of the jet entrainment arrangement can readily be made of greater bore size enabling the installation to deal effectively with larger solids particle sizes. For example particle sizes of 4 inches (95 mm) and larger can be accommodated. Indeed when tank washing machines are employed, for cleaning the holds of ships, the whole cleaning operation can be automated, which further reduces the cleaning time and number of operating personnel.

The entrainment fluid is selected in dependance upon the nature of the solids material and may be fresh water, sea water, oil, compressed air, steam, methyl gas or hexyl alcohol or other suitable liquids, gases or mixtures thereof. With most bulk or combination carrier cargoes, sea water can be used and is used for obvious reasons.

The washing fluid may be high pressure water by itself or water in which air is induced into the water flow.

In order to facilitate the flow of washing fluid entrained solids material from the aperture and into the entrainment jet, means such as a hopper or funnel is advantageously provided for guiding the solids material into entrainment with the jet. Such a hopper or funnel has its wider open upper end fixed to that part of the vessel bottom which defines the aperture and its lower narrower end fixed to a housing which defines an open-topped chamber across which the jet flows, with the open lower end of the hopper or funnel being in communication with the chamber through its open top. This ensures that the solids material is quickly and efficiently directed straight from the vessel bottom into the entrainment jet by means of the high-pressure jets of washing fluid.

The hopper or funnel conveniently has a rim at its upper end which preferably rests on a flange which is inset into the aperture, the inset being of sufficient depth to accommodate the flange, a screen, a sealing gasket and a removable cover such that the cover is flush with the vessel bottom to avoid damage, the cover being in position when the vessel carries solids material and being removed for a cleaning operation.

In a preferred embodiment of the invention, the nozzle means is detachable, e.g. by mounting it in a holder by means such as screw-threads, and projects into the chamber with the nozzle being connected to a source of pressurized fluid via a suitable supply line. The entrainment jet is directed across the chamber and into a mixer chamber for the fluid entrained solids material which in turn is connected, preferably via a diffuser, to the discharge line, which carries the solids material in the flow of fluid engendered by the jet which in the case of a ship can be overboard or alternatively to a suitable storage container on deck, or waste reception tank for subsequent discharge.

The arrangement of the jet nozzle, open-topped and mixer chambers and diffuser, acts as a jet pump which utilises the venturi principle and, as will be appreciated, has the considerable advantage of not having any moving parts.

For any given size of jet entrainment arrangement the particle size to be handled can be optimized by adjusting the distance between the nozzle and mixer entry to relate to the mixer diameter, the ratio of the distance between the nozzle to mixer entry to mixer internal diameter preferably being of the order of 1:1.

With ships having double bottoms, the jet entrainment arrangement is conveniently mounted between adjacent vertically extending floors which run longitudinally of the ship within the double bottom, i.e. between the tank top ceiling and ship bottom and, to provide a chest or enclosed space for the jet arrangement, the opposite open ends of the containing space can be closed off by partitions extending between the adjacent floors.

Again in the case of ships, in particular those having double bottoms, the aperture and thus the entrainment jet could conceivably be located anywhere in and beneath the tank top ceiling (vessel bottom). However, applicants have found that the optimum position for a hold having one such aperture and entrainment jet is adjacent the bilge well which is located in the aft/outboard corner of the or each hold, and this constitutes another preferred feature of the invention. This has the advantage that when the flow of pressurized fluid to the nozzle means is stopped at the end of a cleaning operation, when liquids are used as the cleaning and entrainment fluids, the liquids in the supply and delivery or discharge lines flow back into the hold through the aperture and can enter the adjacent bilge well for discharge by the bilge pump system. If a second entrainment jet is required for the or each ship hold, it can advantageously be positioned in the opposite aft outboard corner of the or each hold.

In accordance with another preferred feature of the invention, a further facility can be provided with the removal sealing cover in position over the aperture in the vessel bottom to clean-out debris. e.g. segiment or rust scale from adjacent double-bottom tanks, and to suck up water from inside the double bottom. When such tanks are used to carry ballast water, such ballast water can include a substantial amount of mud if taken in from the bottom of a river estuary for example. Accordingly, the jet entrainment arrangement is provided with an inlet or aperture which is preferably in the open-topped housing and which is additional to the aperture in the bottom of the vessel, for connection to a fluid line. When the additional inlet is used for cleaning out sediment and scale from the double-bottom tanks and cleaning remaining debris from the vessel bottom, the fluid line is conveniently a flexible hose. The flexible hose can be brought into hold interior through any of the existing normally closed entry apertures for access to the double-bottom tanks. In the case of sucking up water or other liquid from the double-bottom tanks, the fluid line is preferably a rigid length of pipe having an outwardly flared free end. This arrangement is such that a suction is produced enabling debris from the adjacent double-bottom tanks to be sucked through the hose and entrained into the entrainment jet for discharge. When a gas such as air or steam is used as the entrainment fluid a strong vacuum of the order of 24 inches of mercury (0.829 kg/cm$^2$) is produced. The additional inlet is located in the housing wall, advantageously, opposite the opening in the open-topped chamber in the bottom wall of the housing or in a side wall of the housing. This is an extremely important optional feature of the present invention and can eliminate the necessity for bilge pumps since water in the bilges can also be sucked out by means of the vacuum created by the entrainment jet.

The additional inlet or aperture is normally closed, for example by means, of a removable blanking plate or by a manually, electrically, pneumatically or hydraulically operated plate valve. When the inlet is in the bottom wall of the housing the blanking plate or plate of the valve forms in effect the bottom wall, when closed. By providing suitable connections, e.g. of the bolt and flange type, it is a simple manner to connect the flexible hose or flared pipe. The free end of the flared pipe is conveniently located a short distance from the ship bottom inside the double-bottom tank, e.g. about 1 inch (2.54 cm).

In order to ensure that only those particle sizes of the solids material compatible with the jet arrangement and bore size of discharge line are accepted into entrainment jet, a grill or grating may be inset into the aperture around the open funnel or hopper top so as effectively to screen the solids material particle size to the maximum permissable.

In a typical installation either one or two jet entrainment arrangements can be fitted in each ship tank or hold. Where only one jet entrainment arrangement is employed provision will have to be made to ensure a suitable trim to allow for drainage to the arrangement.

All requisite control valves can be at deck level and provision made to break the fluid supply line to ensure against accidental flooding of the holds or tanks in the event of failure to close the deck valve.

Maintenance of the jet entrainment arrangements is minimal and normally involves no more than exchanging nozzles and mixer chambers when after prolonged use these become worn—a simple five minute operation. It is another feature of this invention that replacement of worn mixer chambers and nozzles can be simply and quickly achieved through the aperture. without having to go to the expense of long downtime and replacement of the whole jet entrainment arrangement. Moreover, the nozzle replacement facility enables changing over of nozzles for differing solids material cargoes to optimize efficiency.

Typically, to cover all current ship sizes, the jet entrainment arrangements can be supplied to handle 80, 100, 120 or 240 tons of entrainment water per hour but can handle more if the circumstances require it. In the range given above, the body of the arrangement can be of the same dimensions with the different performance requirements being met simply by varying the jet nozzle and mixer chambers to which end the nozzles are removably mounted in suitable holders and the mixer chambers detachable, as aforesaid.

In the case of a ship, the jet entrainment arrangement can be incorporated into an extension of the conventional bilge well or into a conventional pipe tunnel extending along the centre line of the ship.

When installations constructed according to the invention are installed in existing ships it is a simple matter to cut the necessary aperture in the hold or tank bottom for accommodating the jet entrainment arrangement.

Supply and discharge lines can then be easily run down the hold or tank bulk-heads and beneath the bottom.

When ships are being built with the installations, the vertical lengths of the supply and discharge lines can be disposed behind the tank or hold bulkheads.

Service access can be simply achieved, when it is desired to change the nozzle and/or mixer for example, through the aperture to the entrainment jet, and unbolting the various parts such as the hopper, unscrewing the nozzle and/or unbolting the mixer.

The invention further consists in a kit of parts for use in the production of any of the installations defined hereinabove.

Figure 4:
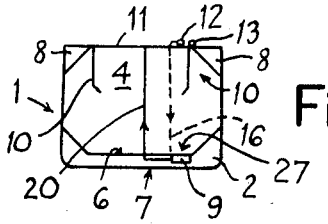
Figure 5:
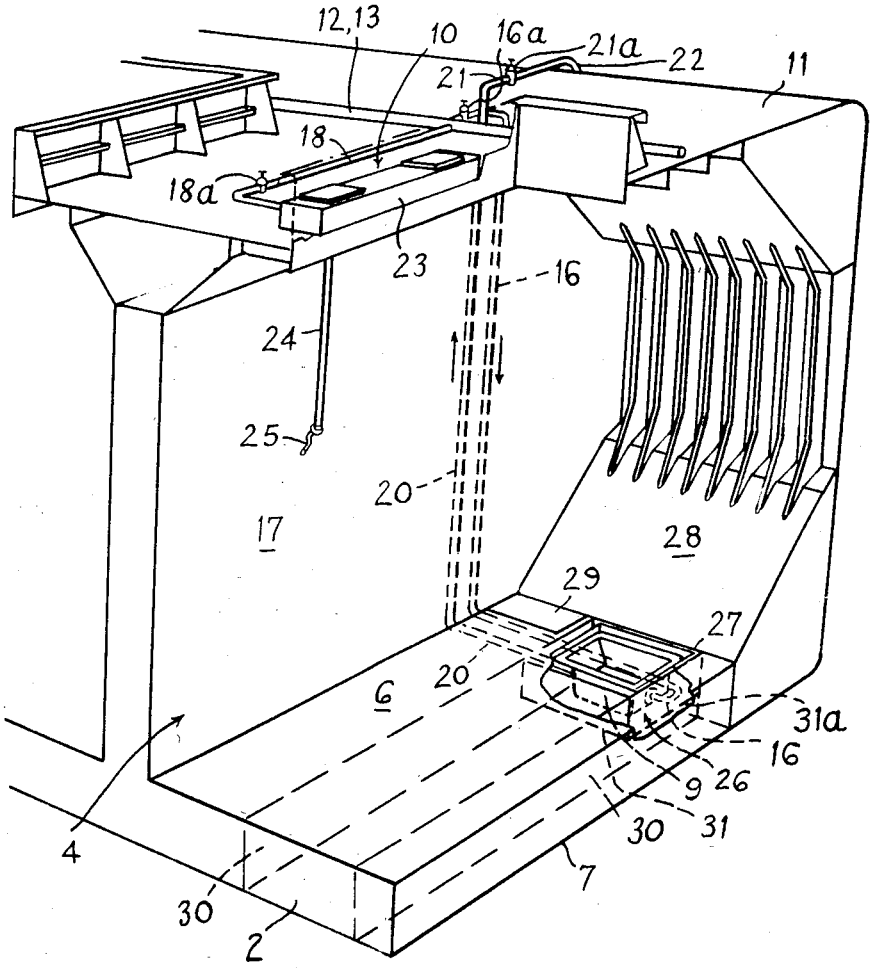
Figure 8:
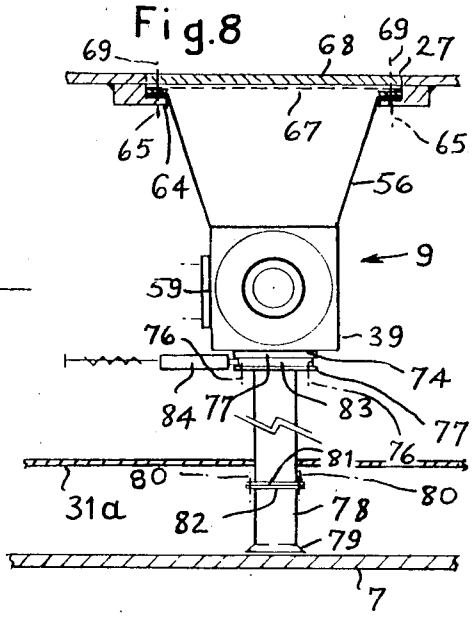
Figure 6:
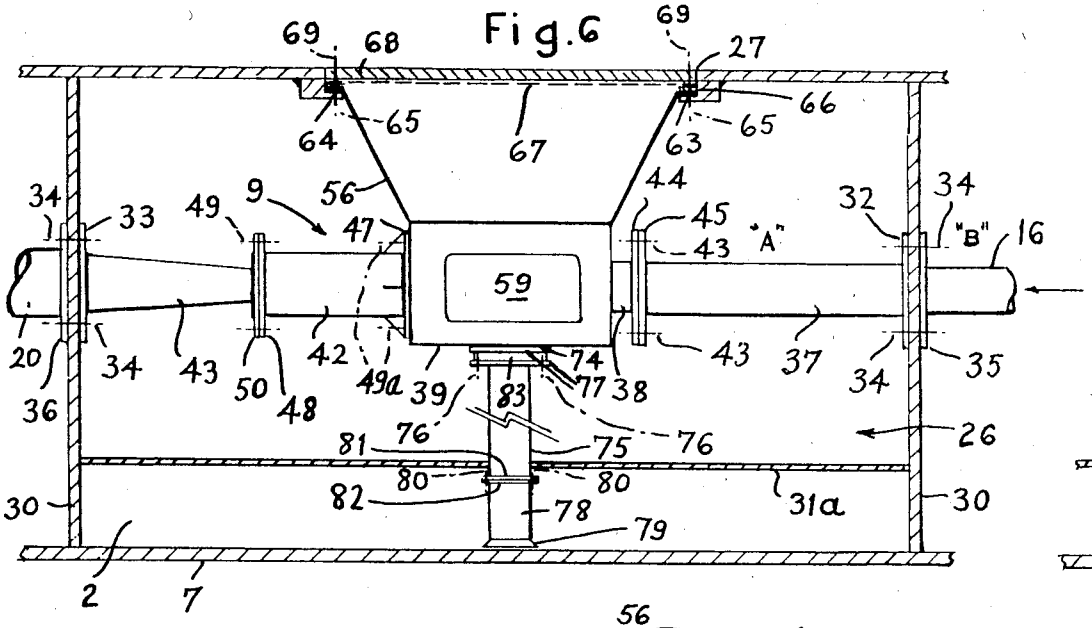
Figure 7:
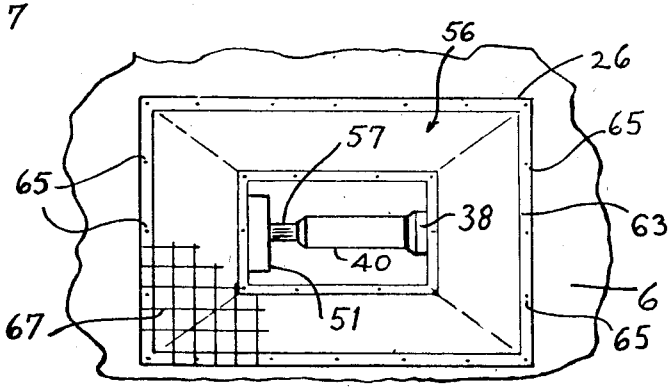
Figure 10:
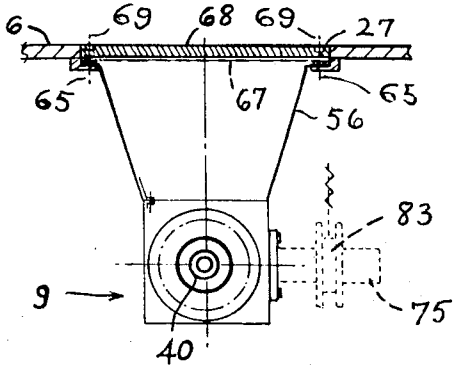
Figure 9:
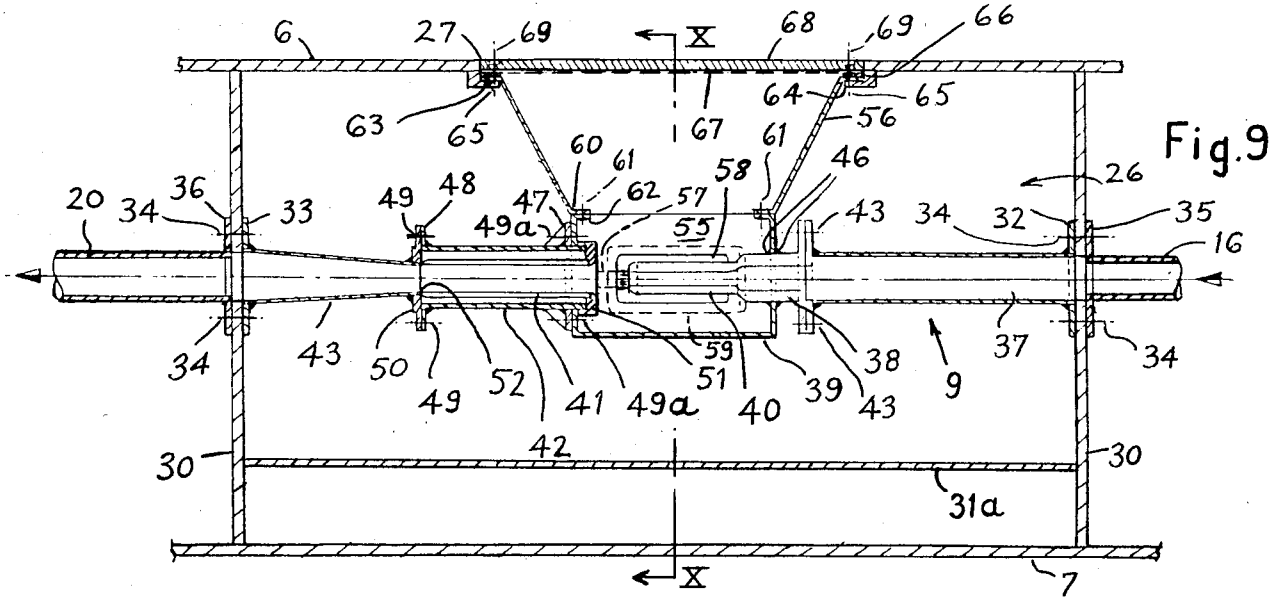
Figure 11:
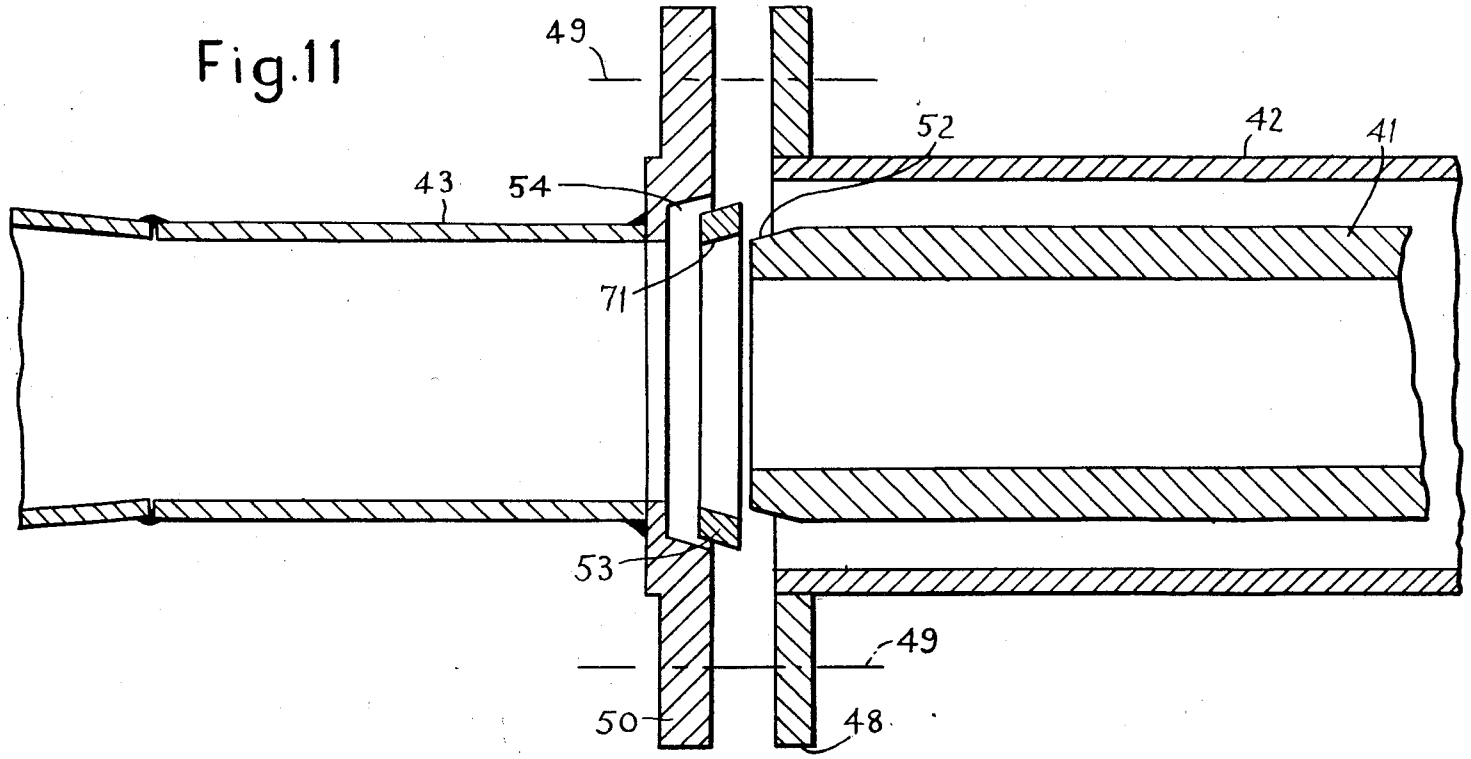
Figure 13:
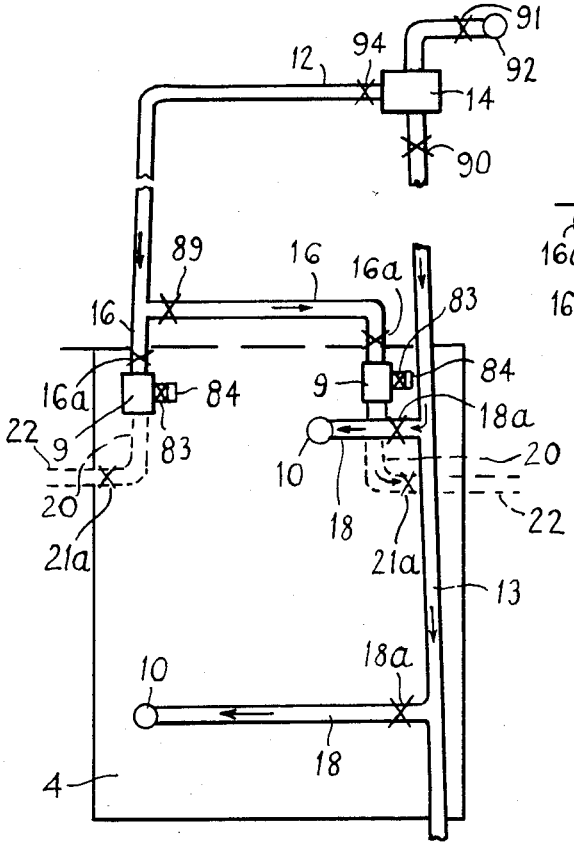
Figure 14:
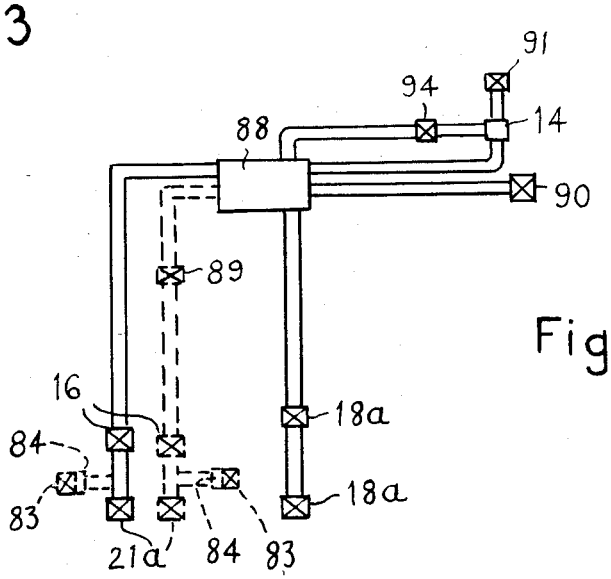

In order that the invention may be more readily understood, reference will now be made to the accompanying drawings, in which:

FIG. 1 is a diagrammatic side elevation through a bulk carrier incorporating an installation constructed in accordance with the present invention, FIG. 2 is a plan view of the bulk carrier of FIG. 1, FIG. 3 is a section through FIG. 1 and showing the bottoms of the holds of the bulk carrier, FIG. 4 is a cross-section through one of the holds of the bulk carrier of FIG. 1, FIG. 5 is a diagrammatic perspective view of one of the holds of the bulk carrier of FIG. 1 with parts broken away, FIG. 6 is a cross-section through the double-bottomed tank of the hold of FIG. 5, showing one form of jet entrainment arrangement, FIG. 7 is a plan view of the jet entrainment arrangement of FIG. 6, FIG. 8 is an end-view of the jet entrainment arrangement of FIG. 6, FIGS. 9 and 10 are cross-sections, through the jet entrainment arrangement of FIG. 6, and taken along the line X—X of FIG. 9, respectively, FIG. 11 shows an alternative mode of locating different sized mixers in the jet entrainment arrangement of FIGS. 6 to 10, FIG. 12 is a flow diagram illustrating one way of operating the installation, FIG. 13 is a flow diagram of the installation, and FIG. 14 is a block diagram of an electrical control circuit for the installation.

Referring to FIGS. 1 to 5 of the drawings, the bulk carrier which is generally indicated by the reference 1 is of double-hulled construction having double-bottom and side tanks 2 and 3 respectively and seven cargo carrying holds 4, constituting vessels for containing solids material, which are closed by respective hatch covers 5. The bottom or deck of each hold 4 on which the solids material rests, is constituted by the tank top ceiling 6 of the associated double-bottom tank 2 and the bottom proper of the bulk carrier is indicated by the reference 7. The bulk carrier is also provided with wing tanks 8 located in the upper regions of the holds 4.

Each hold 4 is provided with an installation for use in cleaning the hold from solids material, such as a cargo of grain, remaining on the tank top ceiling 6 after the discharge of the cargo and prior to loading with another cargo of solids material, for example iron ore. Each installation comprises a jet entrainment arrangement which is hereinafter referred to as a jet pump and which is indicated by the reference 9, and a means for supplying the pressurized jet(s) of washing fluid including two tank washing machines 10. Since the installation is on board a ship, water being readily available, is almost invariably adopted for use as the washing fluid and as the entrainment fluid and, therefore, will be used for the purposes of this description. Mounted on and extending longitudinally of the deck 11 of the bulk carrier 1 are water supply lines in the form of headers 12 and 13 for the jet pumps 9 and the tank washing machines 10 in all the holds 4. The headers 12 and 13 are connected to a single pump 14 of suitable capacity or, alternatively, to respective pumps 14, **14*a* of which the pump 14*a* is shown in dashed lines in FIG. 2. Branch lines 15 extend to each hold from the header 12 and are connected to respective water supply lines 16 having on deck horizontal sections with gate valves 16*a* from which the lines 16 extend vertically down through the holds behind the aft bulkheads 17 and beneath the tank top ceilings 6 to the jet pumps 9. Alternatively, as shown in FIG. 5, one water supply header 12, 13, may supply both the jet pumps 9 and the tank washing machines 10**.

The tank washing machines 10 are connected to the water supply header 13 or to the common water supply header 12, 13 (FIG. 5) by branch lines 18 having gate valves **18*a* therein (FIG. 5). As shown in more detail in FIG. 5, each jet pump 9 has a water entrained solids material discharge line 20 projecting therefrom and horizontally beneath the respective tank top ceiling 6, vertically upwards behind the aft bulkheads 17, out through the deck 11 where there is a horizontal section 21 which extends to a gate valve 21*a* located near one side of the bulk carrier 1. A conveniently flexible hose 22 is connected to the outboard side of the gate valve 21 and leads over the ships side. The discharge line 20 has a diameter which is greater than that of the associated water supply line 16, both the supply and discharge lines 16 and 20 conveniently being metal pipes. The bore size of each discharge line 20 is of greater diameter than that of each supply line 16; for example the discharge lines may have an internal diameter of 4 inches (95 mm) and the supply lines 16 an internal diameter of 3 inches (75 mm). In places where the installation is installed in an existing ship, the supply and discharge lines 16 and 20 conveniently run down the aft bulkhead 17 inside the hold 4**.

Each tank washing machine 10 includes a casing 23 mounted on the deck 11 and a water delivery line 24 depending from the casing 23 and extending through the deck and into the hold 4, the water delivery line 24 terminating in a washing unit 25. The delivery line 24 and the washing unit 25 are retractable into the deck mounted casing 23, from inside the hold 4.

As shown in FIG. 5, each jet pump 9 is disposed in a fluid-tight chest 26, beneath an aperture 27 located in the tank top ceiling 6 aft of each hold 4 adjacent one of the outboard bulkheads 28 and a bilge well 29 in one aft/outboard corner of the hold. The fluid-tight chest comprises portions of floors 30 which extend longitudinally of the ship's hull and vertically between the tank top ceiling 6 and the hull bottom 7, a portion of the bulkhead 28 and partitions 31 and **31*a***.

Additional jet pumps 9 (only three shown by the dashed lines in FIG. 3) may also be located beneath respective apertures in the tank top ceilings 6 in the other aft/outboard corners of each hold 4.

Referring more particularly to FIGS. 6 to 10, each jet pump 9 is mounted in the chest 26 by means of flanges 32, 33 at its opposite ends which are removably fixed as by the diagrammatically illustrated bolts 34 to the floors 30. The bolts 34 also extend through mounting flanges 35 and 36 on the water supply and discharge lines 16 and 20 respectively to secure them to the floors 30 in alignment with apertures therethrough. Passing from its upstream to its downstream ends, the jet pump 9 comprises a supply pipe 37 leading from the supply line 16, a nozzle holder 38 projecting through the upstream end of a housing 39 and carrying a nozzle 40 within the housing, a mixer 41 surrounded by a tubular sleeve 42, the mixer and sleeve projecting into the downstream end of the housing 39 and a diffuser 43 leading into the discharge line 20. The supply pipe 37 and diffuser 43 mount the flanges 32 and 33 respectively. The nozzle holder 38 and supply pipe 37 are removably fixed together as by the diagrammatically illustrated bolts 43 passing through mounting flanges 44 and 45. The nozzle holder 38 passes through an aperture in the housing 39 and is welded in the aperture around weld lines 46.

The mixer sleeve 42 has mounting flanges 47 and 48 located inwardly of its upstream end and at its downstream end respectively through which pass the diagrammatically illustrated bolts 49, 49*a*, which removably fix the sleeve 42 to housing 39 and to a mounting flange 50 which is rigid with the upstream end of the diffuser 43. The sleeve 42 enables interchanging and the locating of different sized mixers, by access through the aperture 26, in a manner to be described. The mixer 41 is located coaxially within the sleeve 42 and with respect to an aperture in the housing 39 through which the upstream end of the mixer and sleeve project by means of a screw-on end cap 51 and to the diffuser 42 by the engagement of the downstream end 52 of the mixer in an annular mating recess (not visible) in the diffuser flange as in FIG. 9 or in a separate annular mounting piece 53 which is located in the diffuser flange recess 54 as shown in FIG. 11.

The nozzle 40 is replacably and adjustably mounted in the nozzle holder 38, for example by means of an external screw thread (not shown) on the nozzle engaging with an internal screw thread (not shown) in the bore of the nozzle holder.

The housing 39 defines an open topped chamber 55 which is in communication through its open top with a hopper or funnel 56 for guiding solids material entrained in the washing water from the aperture and into a pressurized jet 57 of the entrainment liquid generated by the passage of liquid through the nozzle 40. The housing 39 has an access aperture 58 in one of its walls which is closed by a cover or blanking plate 59.

The lower smaller open end of the hopper 56 is provided with an inwardly directed flange 60 which is secured as by the diagrammatically illustrated bolts 61 to an inwardly directed flange 62 which is integral with the housing 39 and extends around the open top of the chamber 55. At its upper wider open, the hopper 56 has an outwardly directed flange or rim 63 which rests on an inwardly projecting annular lip 64 below the aperture 27 and which is removably fixed to the lip 64, by the diagrammatically illustrated bolts 65. An annular sealing gasket 66 is positioned on the rim 63 and a screen or grille 67 for screening solids material particle size to the maximum permissible for the jet pump 9 extends across the aperture 23 and rests at its periphery on the gasket 66. The position of the lip 64 is such that the hopper rim 63, gasket 66, screen 67 and a removable cover 68 are inset in the aperture 27 and the cover 68 is flush with the surface of the tank top ceiling 6. The cover 68 is secured to the lip 64 as by the diagrammatically illustrated bolts 69, with the gasket sealing the cover in the aperture 26, when the hold carries cargo and is removed by undoing bolts 69 for a cleaning operation.

In order to replace the mixer 41 by one of an increased or reduced size, in the embodiment of FIG. 9, the cover 68 is unbolted and removed together with the screen 67 and gasket 66, the bolts 65 and 61 are undone and the hopper is removed through the aperture 27, The nozzle 40 is unscrewed and removed through the aperture 27, The end cap 51 is unscrewed and removed together with the mixer 41 and sleeve 42 through the aperture 26. Since the annular mating recess for the end 52 of the mixer 41 is matched to that mixer, the diffuser is unbolted by undoing bolts 34 and 49 and is removed through the aperture and replaced by a diffuser having an annular recess which matches the end 52 of the replacement mixer and is then located in the annular recess in the flange of the replacement diffuser, and a suitable end cap is screwed back on. A nozzle appropriate to the replacement mixer is screwed into the nozzle holder, the hopper 56 is bolted back into position and the gasket 66, and screen 67 are replaced. This operation can be simply and quickly achieved which is a very important factor in view of the location of the jet pump 9 beneath the tank top ceiling 6.

An even quicker and easier way of changing the mixer 41 since it does not require the diffuser also to be changed can be achieved by use of the annular mounting piece 53 illustrated in FIG. 11. The annular recess 54 in the diffuser flange 50 has been machined out to mate with a tapered external diameter of the mounting piece 53 which locates in recess 54. The mounting piece or ring 53 has a tapered internal bore 71 constituting an annular recess which mates with a complementary taper on the downstream end 52 of the replacement mixer 41. All that needs to be provided is a range of mounting pieces with appropriately shaped bores or recesses 71 for a range of mixers having complementarily shaped downstream ends 52.

These features which facilitate interchanging of mixers are very important aspects of the present invention. The direction of flow of entrainment water through the jet pump 9 is indicated by the illustrated arrow heads in FIG. 9.

Optionally, as shown in FIGS. 6 and 8, the housing 39 is provided with an inlet aperture 74 additional to, and in the bottom wall of the housing 39 opposite to, the aperture 27. The inlet aperture 74 has a vertical pipe 75 fixed to the housing wall by means of the diagrammatically illustrated bolts 76 passing through flanges 77. The pipe 75 may be removably connected either to the vertical pipe or elephants foot 78 having an outwardly flared free end 79 disposed a short distance above the hull bottom 7, by the diagrammatically illustrated bolts 80 passing through flanges 81 and 82 on the pipes 75 and 78 respectively or to a flexible vacuum hose (not shown) having a suitable fixing flange. In FIG. 10 an alternative position for the additional inlet aperture is that provided by the opening 58 when the cover or blanking plate 59 is removed.

In order to open the inlet aperture 74, there is a normally closed plate valve 83 provided with an actuator 84 which biasses the valve into the closed position so that even if the operating mechanism, or circuit for the actuator fails, the plate valve remains closed. This is important as the plate valve 83 should always be closed during a cleaning operation. With the cover 68 closing aperture 27, the plate valve 83 open, and the entrainment jet 57 flowing, the pipe 78 or hose can be used to suck up debris and water from the double-bottom tank 2 and into entrainment with the jet 57.

Figure 12:
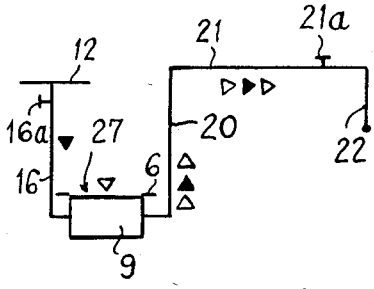

The operation of the installation will now be described with reference to FIGS. 12 to 14 and in relation to one hold 4 of the bulk carrier 1. A control room 88 illustrated diagrammatically in FIG. 14 has appropriate switches for operating the or each pump 9 and supply pump 14 and 14*a* if provided, all the valves and the tank washing machines 10. There are two jet pumps 9 illustrated in FIGS. 13 and 14 and two tank washing machines 10 and an isolation valve 89 is preferably provided in the line 16 leading to one of the jet pumps 9 so that only one jet pump may be used if required. To commence a hold cleaning operation to remove solids material, as represented by the white triangles in FIG. 12, remaining on the tank top ceiling 6 after the discharge of cargo from the hold 4, the cover 68 over the aperture 27 is removed, a supply valve 90 in header 13 upstream of the pump 14, a suction valve 91 in the sea water suction intake line 92 downstream of the pump 14 and the gate valves 18*a* are opened and the tank washing machines 10 are switched on from the control room so that the pressurized washing water passes down lines 18 and lines 24 (FIG. 5) to the washing units 25. A supply valve 94 located in the header 12 downstream of the pump 14, gate valves 16*a* and 21*a* for one jet pump 9 and, if desired, isolation valve 89 as well as gate valves 16*a* and 21*a* for the other jet pump 9 are opened from the control room, so that water under pressure, as represented by the black triangles in FIG. 12, is supplied down lines 16 to each of the jet pumps 9 to generate the entrainment jets 57 (FIGS. 7 and 9). The solids material is washed by the flow of pressurized washing water from the washing units 25 of the tank cleaning machines 10 through the aperture 27 and into entrainment with the pressurized jets 57 and the water entrained solids material, as represented by the black and white triangles in FIG. 12, is discharged through the discharge lines 20 and out of the hold, through the horizontal line sections 21 and overboard through flexible hoses 22.

The deck pressure of the water supplied by the pump 14 to the headers 12 and 13 may, by way of example, be 125 p.s.i. (8.75 kg/cm$^2$).

If it is desired to utilize the vacuum facility of the jet pumps 9 to suck up debris and/or water from the double-bottom tanks 2, either with a flexible hose or the flared pipe 78, the cover 68 must be replaced or be left in position, the or each valve 83 is opened by operating the or each actuator 84 by switches in the control room 88, the pump 14 is operated and the valves 94 and 16*a*, 21*a* for one jet pump 9 and if required the valve 89, and valves 16*a* and 21*a* for the other jet pump are opened, whereby the or each entrainment jet 57 produces a vacuum and the sucked up debris and/or water from the double-bottom tanks is entrained in the entrainment jet(s) and discharged through the line(s) 20 and hose(s) 22.

It will be appreciated that various modifications may be made without departing from the scope of the invention. For example, other washing apparatus utilizing pressurized cleaning fluids may be used instead of the tank washing machines 20.

In the appended claims the term hold means is used generically to embrace the hold of a ship such as a bulk or combination carrier and the tank of an oil bulk ore or oil ore tanker.

I claim:

1. An installation for use in cleaning solids material from the bottom of a vessel, in which the solids material is entrained in at least one pressurized jet of fluid, said installation comprising means defining at least one aperture in the vessel bottom, means for producing a unitary flow of entraining fluid and comprising a pressurized jet of fluid for entraining liquid-borne solids material therein, and disposed in at least one location beneath said vessel bottom and beneath said aperture, said means including a housing defining an open-topped chamber of which the open top is in alignment with, and of smaller size than that of, said aperture and nozzle means disposed in, and extending transversely of, said chamber, for projecting said entrainment jet in a direction which is transversely of said housing and said aperture and generally parallel with said vessel bottom, means for producing at least one pressurized jet of liquid-containing washing fluid for washing solids material from the vessel bottom, through said aperture and into said entrainment jet, means for guiding the washing fluid entrained solids material passing through said aperture into the entrainment jet, said guide means comprising inclined wall means extending downwardly and inwardly from said aperture to said chamber open top and defining an upper wider open end which can be in communication with the vessel interior through said aperture and a lower narrower open end which is in communication with said entrainment jet through said chamber open top and at least one fluid line for the discharge of fluid entrained solids material out of the vessel, whereby in operation said entrainment jet is exposed to the vessel interior through said chamber open top, said lower and upper open ends of said guide means and said aperture, and solids material washed through the aperture by the pressurized washing fluid is guided directly into said entrainment jet to be entrained therein and the fluid entrained solids material is discharged through said discharge line in the fluid flow engendered by the entrainment jet, said inclined wall means being a hopper or funnel with said upper wider open end being provided with an outwardly projecting rim which is inset in the said aperture, which rests on, and is removably fixed to, an annular supporting lip which is rigid with the vessel bottom and which projects beneath said aperature, and with said lower narrower end being removably fixed to said housing around said chamber open top.

2. An installation as claimed in claim 1, characterized in that the lip supports an annular sealing gasket, a screen for screening the solids material particle size to the maximum permissable for the entrainment jet and a cover which closes said aperture when said vessel is carrying solids material and which is removable to open the said aperture for a cleaning operation, said sealing gasket, said screen and said cover being inset in said aperture and said cover having an upper surface which is flush with the vessel bottom.

3. An installation as claimed in claim 1, characterized in that said at least one entrainment jet is directed by said nozzle means into a tubular mixer for the fluid entrained solids material, said mixer being surrounded co-axially by a tubular sleeve of larger internal diameter than the external diameter of said mixer, said mixer and said sleeve having upstream ends which project into said housing opposite said nozzle means, said tubular sleeve being removably fixed towards its upstream end to said housing and at its downstream end to a diffuser which communicates upstream with said mixer and downstream with said fluid discharge line, and means for removably locating said mixer in said sleeve, and with respect to said diffuser and said nozzle means whereby said mixer may be removed with said sleeve through said aperture in said vessel bottom and interchanged with a differently sized mixer.

4. An installation as claimed in claim 3, characterized in that said means for locating said mixer comprises an end cap which removably engages with the upstream ends of said mixer and said sleeve and which has a bore therethrough which aligns with the mixer bore, means defining an annular recess in the upstream end of the diffuser and a downstream end of said mixer which is of complementary shape to said annular recess and which engages therein.

5. An installation as claimed in claim 3, characterized in that said means for locating said mixer comprises an end cap which removably engages with the upstream ends of said mixer and said sleeve and has a bore therethrough which aligns with the mixer bore, means defining an annular recess in the upstream end of said diffuser, an annular mounting piece having a mating portion having a shape which is complementary to that of, and engaging in, the annular recess, means defining a mating recess in said mounting piece and a downstream end of said mixer which is of complementary shape to said another annular recess and which engages therein.

6. An installation as claimed in claim 1, characterized in that the nozzle means is adjustably and removably mounted in a holder means which is fixed to and projects into said housing.

7. An installation as claimed in claim 1, characterized by means defining a space beneath said vessel bottom, means defining another aperture in said housing which is additional to said aperture in said vessel bottom, which is normally closed and which is communicatable with said chamber and with said space, means for connecting a suction line to said another aperture and leading into said space and means for opening said another aperture; whereby in operation of said entrainment jet, when said aperture in said vessel bottom is closed, said another aperture is open and said suction line is connected to at least one of debris and liquid in said space and may be sucked through said suction line and into entrainment with said entrainment jet for discharge in the fluid flow engendered in said entrainment jet.

8. An installation as claimed in claim 7, characterized in that said means for opening said another aperture comprises a valve which is biassed into a closed position and actuator means which is operable to open said valve.

9. An installation as claimed in claim 1, characterized in that said nozzle means is connected to a source of pressurized fluid through a supply line and in that said discharge line has a bore size which is of greater diameter than that of said supply line and which is capable of accommodating solids material particle sizes at least of the order of 4 inches (95 mm).

10. A ship incorporating an installation as claimed in claim 1, characterized in that the vessel is a hold means of the ship.

11. A ship as claimed in claim 10, characterized in that the means for producing the pressurized entrainment jet is incorporated into an extension of a bilge well or into a pipe tunnel extending along the centre line of the ship.

12. A ship as claimed in claim 10, characterized in that the supply and discharge lines extend from deck level and down at least one bulkhead of the hold means and beneath the bottom of the hold means.

13. A ship as claimed in claim 12, characterized in that vertical lengths of the supply and discharge lines are disposed behind the bulkhead of the hold means.

14. A ship as claimed in claim 10, characterized in that the supply, washing jet and discharge lines have control valves, all of which are located at deck level, with one of the control valves being operative to shut-off fluid flow to the supply line and washing jet line to ensure against accidental flooding of the hold means.

15. A ship as claimed in claim 10, characterized in that the aperture in the hold means beneath which the means for producing the pressurized entrainment jet is disposed is located adjacent means defining a bilge well in one aft/outboard corner of the hold means.

16. A ship as claimed in claim 15, characterized in that the hold means has a second means for producing a pressurized jet of entrainment fluid and disposed beneath a second aperture in the bottom of the hold means, said second aperture being located in the other aft/outboard corner of said hold means.

17. A ship incorporating an installation as claimed in claim 1, characterized in that the ship has a deck, a plurality of said vessels constituted by cargo carrying hold means beneath said deck and characterized by means defining a plurality of double-bottom tanks including tank top ceilings forming the bottoms of said hold means and the bottom of the ships's hull, each hold means being provided with at least one of said means for producing a pressurized jet of entrainment water constituted by a jet pump and disposed beneath a respective said aperture in the respective tank top ceiling and located in a position which is aft of the respective hold means, at least one supply pump for supplying a pressurized flow of water to said jet pumps and to said means for producing at least one pressurized jet of washing water, said pump being connected to a water suction inlet line and to header means extending lengthwise of the deck, first branch lines extending from said header means and communicating with water supply lines extending down into the respective hold means along bulkheads of said hold means, said water supply lines extending beneath the respective tank top ceilings and being connected to respective ones of said jet pumps, discharge lines leading from jet pumps beneath said tank top ceilings, up the bulkheads to the ship's deck and over one of the ship's sides, second branch lines extending from said header means and communicating with respective said washing water jet producing means of which there is at least one for each hold means, each said means having delivery lines terminating in washing units, which delivery lines and units project into the hold means for a cleaning operation and are retractable therefrom when the hold means are to be loaded with solids material cargo, deck level mounted valve means in said suction inlet line, in said header means, in said supply lines, in said second branch lines and in said discharge lines for controlling the flow of water therethrough, and characterized in that said inclined wall means is a hopper or funnel with said upper wider open end being provided with an outwardly projecting rim which is inset in the said aperture, which rests on, and is removably fixed to, an annular supporting lip which is rigid with the tank top ceiling and which projects beneath the said aperture, and with said lower narrower end being removably fixed to said housing around said chamber open top.

18. An installation as claimed in claim 1, characterized in that means are provided for removably fixing said guide means to said vessel bottom and to said housing, whereby said guide means may be removed through said aperture.

19. An installation as claimed in claim 18, characterized in that said at least one entrainment jet is directed by said nozzle means into a tubular mixer for the fluid entrained solids material, said mixer being surrounded co-axially by a tubular sleeve of larger internal diameter than the external diameter of said mixer, means removably mounting said mixer and said sleeve, and means removably locating said mixer in said sleeve and with respect to said nozzle means, whereby when said guide means has been removed through said aperture, said mixer may also be removed with said sleeve through said aperture and be interchanged with a differently sized mixer.

20. An installation as claimed in claim 1, characterized in that the nozzle means is adjustably and removably mounted in a holder means which is fixed to and projects into said housing and said chamber, and in that said nozzle means is at a distance from a tubular mixer for the fluid entrained solids material and having an entry into which the entrainment jet is directed by the nozzle means, whereby the distance between the nozzle means and the mixer entry can be adjusted to relate to the mixer internal diameter and thereby optimize the solids material particle size to be handled by a given size of said entrainment jet producing means.

21. An installation as claimed in claim 20, characterized in that the ratio of the distance between the nozzle means and mixer entry to mixer internal diameter is of the order of 1:1.

* * * * *

UNITED STATES PATENT AND TRADEMARK OFFICE

CERTIFICATE OF CORRECTION

PATENT NO. : 4,587,985

DATED : May 13, 1986

INVENTOR(S) : Raymond Flanagan

It is certified that error appears in the above-identified patent and that said Letters Patent is hereby corrected as shown below:

Column 1, line 49, "cargon" should be -- cargo --.

Column 3, line 21, "measns" should be -- means --.

Column 3, line 68, "." should be -- , --.

Column 4, line 17, "Morover" should be -- Moreover --.

Signed and Sealed this

*Nineteenth* Day of *August 1986*

[SEAL]

*Attest:*

DONALD J. QUIGG

*Attesting Officer*

*Commissioner of Patents and Trademarks*